US006834660B1

(12) United States Patent
Van Wart, Jr.

(10) Patent No.: US 6,834,660 B1
(45) Date of Patent: Dec. 28, 2004

(54) CANE AND LIFT ASSIST DEVICE

(76) Inventor: Fergus M. Van Wart, Jr., 631 Village La. South Suite A, Mandeville, LA (US) 70471

( * ) Notice: Subject to any disclaimer, the term of this patent is extended or adjusted under 35 U.S.C. 154(b) by 0 days.

(21) Appl. No.: 10/421,413

(22) Filed: Apr. 23, 2003

Related U.S. Application Data

(60) Provisional application No. 60/434,095, filed on Dec. 17, 2002.

(51) Int. Cl.[7] ..... A61H 3/02

(52) U.S. Cl. ..... 135/72

(58) Field of Search ..... 5/662, 658, 652; 135/72, 66, 76, 68, 71; 248/155

(56) References Cited

U.S. PATENT DOCUMENTS

| | | | | | |
|---|---|---|---|---|---|
| 2,736,330 | A | * | 2/1956 | Wood | 135/68 |
| 3,289,685 | A | | 12/1966 | Parker | |
| 3,304,946 | A | * | 2/1967 | Lutes | 135/69 |
| 3,768,495 | A | * | 10/1973 | Smith | 135/72 |
| 3,995,565 | A | | 12/1976 | Kersey | |
| 4,099,535 | A | * | 7/1978 | Hubachek | 135/66 |
| 4,809,725 | A | * | 3/1989 | Champigny | 135/75 |
| 4,838,291 | A | * | 6/1989 | DiVito | 135/68 |
| 4,932,090 | A | | 6/1990 | Johansson | |
| 5,482,070 | A | * | 1/1996 | Kelly | 135/66 |
| 5,495,867 | A | | 3/1996 | Block | |
| 5,785,070 | A | | 7/1998 | Block et al. | |
| 6,012,182 | A | | 1/2000 | Allen et al. | |
| 6,024,110 | A | * | 2/2000 | Renfro | 135/66 |
| 6,044,507 | A | | 4/2000 | Smith | |
| 6,085,766 | A | * | 7/2000 | Geary | 135/75 |
| 6,192,908 | B1 | * | 2/2001 | Smith | 135/66 |
| 6,276,007 | B1 | | 8/2001 | Brown | |
| 6,311,942 | B1 | | 11/2001 | Rotter et al. | |

* cited by examiner

*Primary Examiner*—Leslie A. Braun
*Assistant Examiner*—Kofi Schulterbrandt
(74) *Attorney, Agent, or Firm*—Garvey, Smith, Nehrbass & Doody, L.L.C.; Seth M. Nehrbass; Charles C. Garvey, Jr.

(57) ABSTRACT

The combined walking cane and lift assist device of the present invention is used to help or assist a person to stand up from a sitting position or sit down from a standing position. The cane and lift assist device can be used to assist a user to stand up from a sitting position or sit down from a standing position. The apparatus can include a cane shaft having an upper end and a lower end, a first, upper handle attached to the upper end of the cane shaft, a second, lower handle attached to the shaft below the first, upper handle, and a resilient tip attached to the lower end of the cane, wherein the lower handle is rotatable up to 180 degrees with respect to the upper handle, so that the upper and lower handles can be vertically aligned when the user is using the device as a cane, and the lower handle can be offset up to 180 degrees with respect to the upper handle when the device is used to assist the user when moving between a sitting position and a standing position.

19 Claims, 2 Drawing Sheets

CANE AND LIFT ASSIST DEVICE

CROSS-REFERENCE TO RELATED APPLICATIONS

Priority of U.S. Provisional Patent Application Ser. No. 60/434,095, filed 17 Dec. 2002, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to canes and walking aids. More particularly, the present invention relates to and improved cane and lift assist device that has an upper end portion with a pair of spaced apart handles, wherein one handle (lower) can be rotated so that the handles are on opposite sides of a linear cane shaft, enabling a user to more easily support and distribute some of his or her weight and thus move from a sitting position to a standing position.

2. General Background of the Invention

The following table lists U.S. patents that disclose cane devices that in some cases include dual handles. Each patent in the following table is hereby incorporated herein by reference.:

| U.S. PAT. NO. | TITLE | Issue Date |
|---|---|---|
| 3,289,685 | Step Stick Walking Aid | 12-06-1966 |
| 3,995,565 | Extensible Telescoping Cargo Brace | 12-07-1976 |
| 4,932,090 | Movable Support Bar | 06-12-1990 |
| 5,495,867 | Dual Handled Cane | 03-05-1996 |
| 5,785,070 | Dual Handled Walking and Assist Device | 07-28-1998 |
| 6,012,182 | Bed-Rise or Chair-Rise Assist Apparatus | 01-11-2000 |
| 6,044,507 | Apparatus for Assisting A Human between Sitting and Erect Positions relative to a Chair or any Similar Structure | 04-04-2000 |
| 6,276,007 | Personal Lift Lid | 08-21-2001 |
| 6,311,942 | Bedside Cane Holder | 6,311,942 |

BRIEF SUMMARY OF THE INVENTION

The apparatus of the present invention is a combined cane and lift assist device.

The present invention includes two handles, the lower of which can rotate on an elongated linear cane shaft relative to the upper. The present invention can be used to help one to get up from a chair or to sit down in a chair.

The present invention provides a combined cane and lift assisting device that assists a user to stand up from a sitting position or to sit down from a standing position. The apparatus includes a cane shaft having an upper end portion and lower end portion. A first, upper handle is attached to the upper end portion of the cane shaft.

A second, lower handle is attached below the first upper handle and at a position spaced away from the first, upper handle.

The lower handle is rotatable with respect to the upper handle, preferably about one hundred eighty (180) degrees but it can be positioned at any angular position with respect to the top handle between zero and one hundred eighty (180) degrees. This offset arrangement of the upper and lower handle assists a user when moving between a sitting position and a standing position, because it enables the user to place his or her hands on opposing sides of the cane shaft thus providing better weight distribution and balance.

Additionally, preferably only the lower handle is rotatable so that user can first steady the cane shaft by gripping the upper, non-rotating handle before rotating the lower handle to a selected position.

The apparatus can optionally be provided with a lower tip end portion which is resilient such as being made of rubber, polymeric material (e.g., polyurethane) or other resilient material.

The cane shaft can be made of a lightweight yet strong material such as fiberglass tubing, composite material, lightweight metal or metal alloy material such as titanium or aluminum.

The apparatus of the present invention thus provides a cane and lift assist device to assist the user to stand up from a sitting position or to sit down from a standing position.

The apparatus includes a cane shaft having upper and lower end portions. A first upper handle is attached to the upper end portion of the cane shaft at the top of the cane shaft. A second, lower handle is attached to the cane shaft below the first, upper handle.

Each of the handles preferably mounts to one or more cylindrically shaped sleeves that each have an interior bore that closely fits the external surface of the cane shaft. Preferably only the lower handle is rotatable with respect to the cane shaft. In this fashion, the upper and lower handles can be selectively vertically aligned, such as when the user wants to operate the device as a cane, or can be offset with respect to each other when the device is to be used to assist the user when moving between a sitting position and a standing position.

One or more of the handles can provide a diagonally extending or curved support that extends from a position on the handle spaced away from the cane shaft to a position below the handle and connected to the shaft, preferably with a sleeve.

A stop can be attached to the cane shaft below the lower handle. The stop can be, for example, in the form of a cylindrically shaped or annular ring.

Preferably both of the handles have an upper sleeve and a lower sleeve, wherein the handle attaches to the upper sleeve and a diagonally extending support attaches to a lower sleeve and to the extreme outer end portion of the handle.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
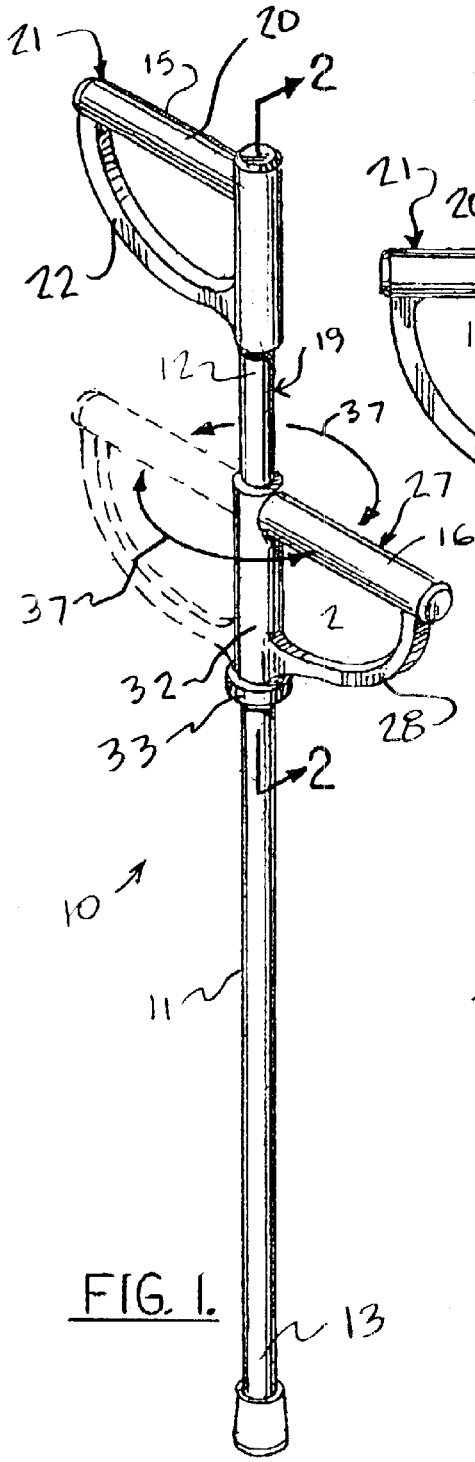
FIG. 1 is a perspective view of the preferred embodiment of the apparatus of the present invention.
Figure 2:
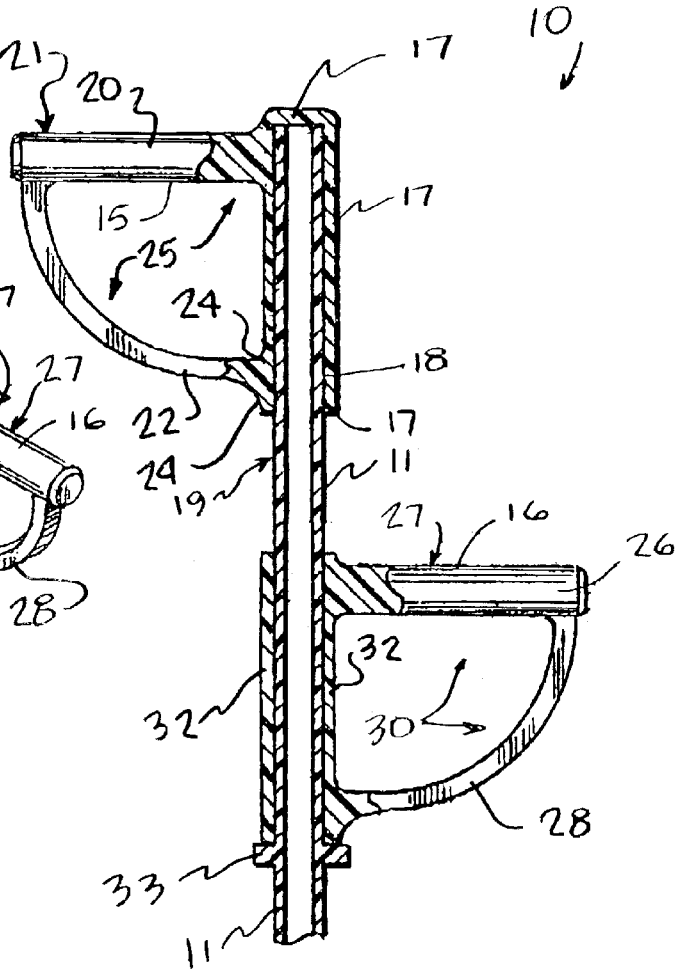
FIG. 2 is a partial sectional, elevation view of the preferred embodiment of the apparatus of the present invention.

FIGS. 1–2 show generally the preferred embodiment of the apparatus of the present invention designated generally by the numeral 10. Combined cane and lift assist apparatus 10 provides an elongated preferably cylindrically shaped shaft 11 that has an upper end portion 12 and a lower end portion 13. End portion 13 can be fitted with a resilient tip 14 that can be of a polymeric material or other resilient material, such as rubber. Tip 14 can be of a soft polymeric material such as polyurethane.

Figure 3:
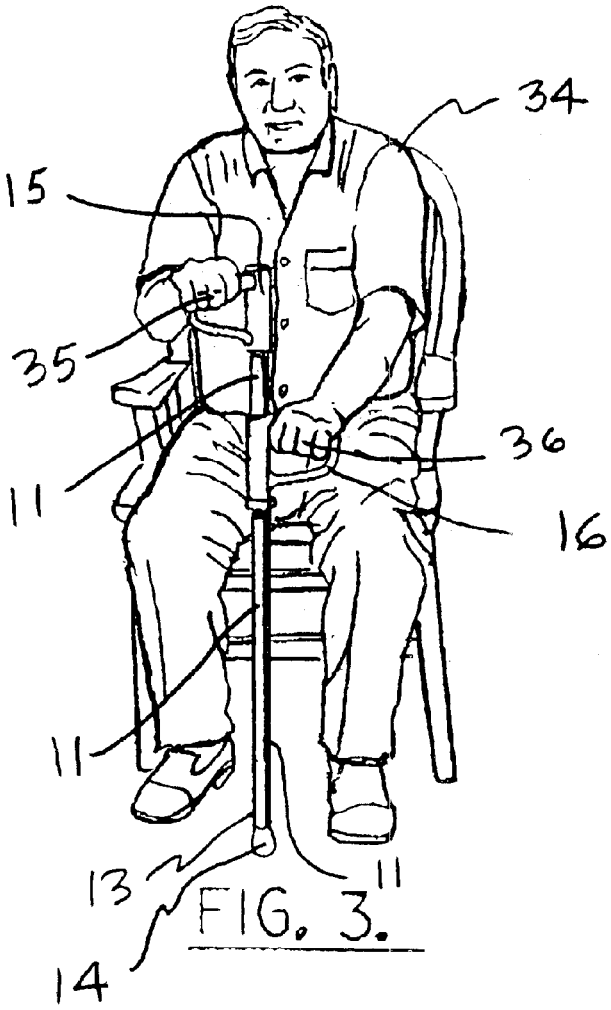
FIG. 3 shows the invention in use with the user sitting down.
Figure 4:
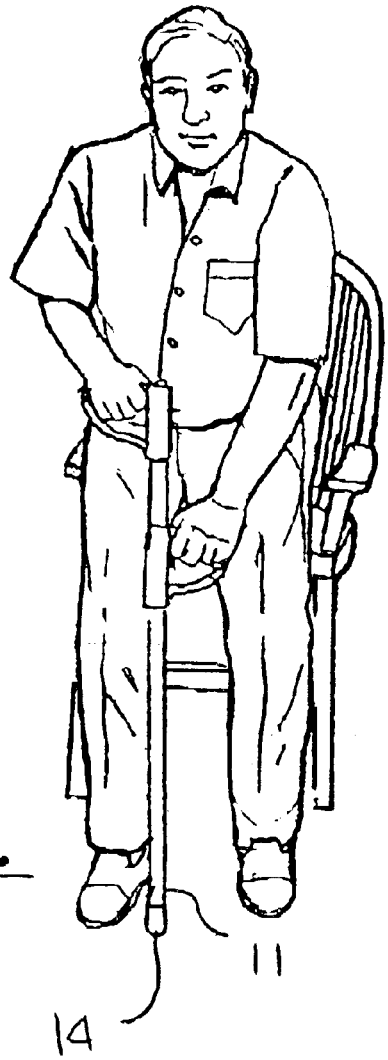
FIG. 4 shows the invention in use with the user getting up.

An upper handle 15 mounts to the upper end portion 12 of shaft 11. A lower handle 16 attaches to shaft 11 just below upper handle 15 as shown in FIGS. 1 and 2. The upper handle 15 is comprised of one, two or more generally cylindrically shaped sleeves 17 having a hollow bore 18 that closely fits the cylindrically shaped outer surface 19 of shaft 11. Horizontal section 20 of upper handle 15 extends away from the upper end portion of sleeve 17. For use as a cane when walking the lower handle 16 is aligned with upper handle 15 as shown in phantom lines in FIG. 1. Sleeve 17 is closed at its upper end (see FIG. 2) so that handle 15 is secured to the top of shaft 11. Handle 15 is preferably secured to shaft 11 so that it does not rotate, using an adhesive, rivet, bolt, screw or like connection. In this fashion, when a user 34 is ready to use the apparatus 10 to aid him or her when rising from a seated position (FIG. 3) to a standing position (FIG. 4), the non-rotating, upper handle 15 is first firmly gripped. This preliminarily stabilizes the user 34. The user then rotates lower handle 16 to a position that spaces horizontal sections 20, 27 about 90–180 degrees apart (see FIGS. 1, 2, 3, 4) and then grips the handle 16 with fingers 36 of his or her other hand. Because shaft 11 is now centered between handles 15, 16 there is little or no bending moment that tends to rotate shaft 11 from a substantially vertical position and thus provides a stable crutch for aiding the user during lift from FIG. 3 to FIG. 4.

Horizontal section 20 provides an outer gripping surface 21 that can be covered with a soft foam, rubber sleeve or other material that helps a user obtain a good grip on the horizontal section 20 during use. A diagonally extending support 22 extends from the outer end 23 portion of horizontal section 20 connecting at 24 with sleeve 17. The space 25 that is surrounded by sleeve 17, horizontal section 20 and support 22 enables a user 34 to place his or her fingers 35 through the space 25 when gripping the surface 21 of horizontal section 20 (see FIGS. 1–4).

Lower handle 16 similarly provides sleeve 31 and horizontally extending section 26 having an outer gripping surface 27. Sleeve 31 has bore 32 that closely fits outer surface 19 of shaft 11. A diagonally extending support 28 extends from an outer end of horizontal section 27 to the lower end of sleeve 32 (FIGS. 1–2). A space 30 is provided that is surrounded by sleeve 31, diagonally extending support 28, and horizontal section 26. A user's fingers 36 fit space 30 when the user 34 grips handle 16.

A stop 33 is positioned below handle 16 and more particularly under sleeve 32. The stop 33 prevents the sleeve 31 of lower handle 16 from dropping below stop 33. The sleeve 31 can spin (see arrows 37 in FIG. 1) with respect to shaft 11 so that the handle 16 can be placed in an opposed position as shown in FIG. 2 that is spaced about 180 degrees from upper handle 15.

Parts List

The following is a list of parts and materials suitable for use in the present invention:

| Parts No. | Description |
|---|---|
| 10 | cane and lift assist apparatus |
| 11 | shaft |
| 12 | upper end portion |
| 13 | lower end portion |
| 14 | tip |
| 15 | upper handle |
| 16 | lower handle |
| 17 | sleeve |
| 18 | bore |
| 19 | outer surface |
| 20 | horizontal section |
| 21 | surface |
| 22 | support |
| 23 | end portion |
| 24 | connection |
| 25 | space |
| 26 | horizontal section |
| 27 | surface |
| 28 | support |
| 29 | end portion |
| 30 | connection |
| 31 | sleeve |
| 32 | bore |
| 33 | stop |
| 34 | user |
| 35 | fingers |
| 36 | fingers |
| 37 | arrow |

The foregoing embodiments are presented by way of example only; the scope of the present invention is to be limited only by the following claims.

What is claimed is:

1. A combined walking cane and lift assist apparatus to assist a user to stand up from a sitting position or to sit down from a standing position, comprising:

a) a cane shaft having an upper end and a lower end;

b) a first, upper handle attached to the upper end of the cane shaft;

c) a second, lower handle that is rotatably mounted upon the cane shaft below the first, upper handle;

d) a resilient tip attached to the lower end of the cane; and e) an annular support on the cane shaft below the second lower handle, the second lower handle being supported by and rotatable up to 180 degrees upon the annular support and with respect to the upper handle, so that the upper and lower handles can be vertically aligned when the user is using the device as a cane, and the lower handle can be offset up to 180 degrees with respect to the upper handle when the device is used to assist the user when moving between a sitting position and a standing position.

2. The apparatus of claim 1, wherein the resilient tip is made of rubber and the cane is made of fiberglass tubing.

3. The apparatus of claim 1 further comprising a ring attached to the cane below the lower handle.

4. The apparatus of claim 3, wherein the ring is made of brass.

5. The apparatus of claim 1, wherein the handles are made of molded plastic.

6. The apparatus of claim 2, wherein the tubing has an outside diameter of about one inch.

7. The apparatus of claim 1 wherein the upper handle is fixed to the shaft and not rotatable upon the shaft.

8. The apparatus of claim 1 wherein the upper handle has a tubular sleeve with a bore that fits the outer surface of the cane shaft.

9. The apparatus of claim 1 wherein the lower handle has a tubular sleeve with a bore that fits the outer surface of the cane shaft.

10. The apparatus of claim 1 wherein the cane shaft has a central linear axis and the lower handle rotates upon the cane shaft about the central linear axis.

11. A cane and lift apparatus device to assist a user to stand up from a sitting position or to sit down from a standing position, comprising:

a) a cane shaft having upper and a lower end portions;

b) a first, upper handle attached to the upper end portion of the cane shaft;

c) a bearing attached to the cane shaft below the first upper handle; and d) a second, lower handle attached to the cane shaft below the first, upper handle;

wherein the lower handle is supported by and is rotatable upon the bearing and with respect to the upper handle, so that the upper and lower handles can be selectively vertically aligned, or offset with respect each other when the device is used to assist the user when moving between a sitting position and a standing position.

12. The apparatus of claim 11, further comprising a diagonally extending support on at least one of the handles that extends from a position spaced away from the cane shaft to a position below the handle and connected to the shaft.

13. The apparatus of claim 11, further comprising a stop attached to the cane below the lower handle.

14. The apparatus of claim 11 wherein the stop is an annular member affixed to the outer surface of the cane shaft.

15. The apparatus of claim 12 wherein at least one of the handles has a sleeve and the diagonally attached support is attached to the sleeve.

16. The apparatus of claim 12 wherein at least one of the handles has one or more sleeves that attach the handle to the cane shaft, and the diagonally attached support is attached to one of the sleeves.

17. The apparatus of claim 11 wherein the upper handle is fixed to the shaft and not rotatable upon the shaft.

18. The apparatus of claim 11 wherein the upper handle has a tubular sleeve with a bore that fits the outer surface of the cane shaft.

19. The apparatus of claim 11 wherein the cane shaft has a central linear axis and the lower handle rotates upon the bearing and about the central linear axis.

* * * * *